US005234132A

United States Patent [19]

Bachand et al.

[11] Patent Number: 5,234,132

[45] Date of Patent: Aug. 10, 1993

[54] ACTUATOR FOR DISPENSING PUMP

[75] Inventors: George Bachand, Plantsville, Conn.; Brian Chase, Woodland Hills, Calif.; Cleve A. Graham, Simi Valley, Calif.; Allan B. Johnson, Tarzana, Calif.

[73] Assignee: The Gillette Company, Boston, Mass.

[21] Appl. No.: 891,293

[22] Filed: May 29, 1992

[51] Int. Cl.[5] ..... B67D 5/06

[52] U.S. Cl. ..... 222/182; 222/321

[58] Field of Search ..... 222/153, 182, 321, 383-385

[56] References Cited

U.S. PATENT DOCUMENTS

| | | | |
|---|---|---|---|
| D. 255,549 | 6/1980 | Kirk | D9/448 |
| D. 255,550 | 6/1980 | Kirk | D9/448 |
| D. 269,327 | 6/1983 | Kotuby | D9/448 |
| D. 308,944 | 7/1990 | Lasoro | D9/448 |
| 3,227,321 | 1/1966 | Sagarin | 222/182 X |
| 3,263,869 | 8/1966 | Corsette | 222/182 |
| 3,276,641 | 10/1966 | Lehmann | 222/321 X |
| 3,286,885 | 11/1966 | Huling | 222/182 |
| 3,306,497 | 2/1967 | Kenney et al. | 222/321 X |
| 3,401,843 | 9/1968 | Ahrens et al. | 222/321 X |
| 3,460,719 | 8/1969 | O'Donnell et al. | 222/320 |
| 3,881,638 | 5/1975 | Grothoff | 222/182 X |
| 4,174,052 | 11/1979 | Capra et al. | 222/207 |
| 4,193,551 | 3/1980 | Saito et al. | 222/321 X |
| 4,222,500 | 9/1980 | Capra et al. | 222/499 |
| 4,278,187 | 7/1981 | Luedtke | 222/321 X |
| 4,361,255 | 11/1982 | Saito et al. | 222/321 |
| 4,420,096 | 12/1983 | Kirk | 232/321 |
| 4,817,829 | 4/1989 | Fuchs et al. | 222/321 X |
| 4,863,074 | 9/1989 | Quennessen | 222/402.13 |
| 4,889,262 | 12/1989 | Toms | 222/321 X |
| 5,027,982 | 7/1991 | Demarest | 222/182 |
| 5,152,435 | 10/1992 | Stand et al. | 222/321 |

FOREIGN PATENT DOCUMENTS

| | | | |
|---|---|---|---|
| 1444567 | 5/1966 | France | 222/321 |

*Primary Examiner*—Kevin P. Shaver

*Attorney, Agent, or Firm*—Owen J. Meegan; Aubrey C. Brine; Donal B. Tobin

[57] ABSTRACT

Apparatus for dispensing a cosmetic or the like from a container having a pump with an operating stem with a free end extending above the container, through which material is dispensed from the container by movement of the stem, is formed of a shroud member and an actuator. The shroud member is mounted on the container with the operating stem extending into its tubular outer wall and the actuator is mounted in the shroud with a cylindrical outer surface in slidable engagement with the inner surface of the shroud tubular outer wall and engageable with the operating stem to pump material from the container through a conduit in the actuator to an outlet disposed above an inwardly extending recess in the shroud member tubular outer wall.

13 Claims, 4 Drawing Sheets

ACTUATOR FOR DISPENSING PUMP

BACKGROUND OF THE INVENTION

The present invention relates to pump actuators and more particularly to apparatus for dispensing a cosmetic or the like from a container having a pump with an operating stem extending from the container, and to which the actuator assembly is applied.

Various types of cosmetics or the like are provided in containers from which the material is pumped by means of a somewhat standardized pump arrangement. That is, the pump generally includes an operating stem which extends from the container top and has a free end, the pump stem when moved downwardly and returned to the upward position being effective to pump the material from the container. The pump arrangement is particularly adaptable to those materials where a small amount is required by the user as the quantity may be controlled by moving the pump stem over a small portion of its travel to dispense a required amount of material.

In the retailing of a product which is to be dispensed from a container as described, an attempt is generally made to combine the pump with an actuator assembly in a manner to provide a compact and simple to use unit. It is also desirable that the unit be easily carried by the user with the accidental actuation of the pump being minimized.

Further, it is highly desirable to provide an actuator assembly which is effective to pump materials from the bottom of the container, to ensure that a maximum amount of material has been removed from the container prior to its being discarded. Many pumps are provided with prior art actuator assemblies which require the container to be tipped during usage, thereby lessening the probability of obtaining a maximum amount of material contained in the container. Other actuator assemblies are provided which extend outwardly from the container and therefore are not compact and are subject to erroneously being activated when carried by the user.

It is therefore an object of the present invention to provide apparatus for dispensing cosmetics or the like which is simple to use and easily fabricated.

A further object of the invention is to provide apparatus for dispensing a cosmetic or the like from a container which may be operated without tilting the container to receive the material being dispensed.

Another object of the invention is to provide apparatus for dispensing a cosmetic or the like wherein accidental operation of the dispensing apparatus is minimized.

Yet another object of the invention is to provide apparatus of the type described which is compact, attractive in appearance and may be adapted to any container having a pump with a stem extending from the container to pump material therefrom.

SUMMARY OF THE INVENTION

The above objects, any other objects which will become apparent as the description proceeds, are accomplished by providing apparatus for dispensing a cosmetic or the like from a container having a pump including an operating stem extending from the container top and having a free end, the pump stem being movable downwardly to pump material from the container through an opening in the stem. The apparatus includes a shroud member having a tubular outer wall open at the top and bottom and a radially extending platform having a centrally disposed opening formed therein located between the top and bottom opening. The shroud member is mounted on the container with the operating stem extending through the platform opening and the outer wall has a front slotted opening formed therein extending from the top of the outer wall to a point above the platform and terminating at an inwardly extending recess formed in the outer wall.

An actuator is provided having a cylindrical outer surface for slidable engagement with the inner surface of the shroud tubular wall and a top wall. Means are disposed on the bottom surface of the top wall for contacting the stem and moving the stem downwardly to actuate the pump when the actuator is moved downwardly and conduit means are disposed in the actuator having an inlet communicating with the opening in the stem and an outlet disposed above the inwardly extending recess in the shroud member tubular wall.

The apparatus may contain stop means for controlling downward movement of the actuator to limit the quantity of material dispensed by the apparatus and the recess in the shroud outer wall is generally of a concave cross-section to provide for extending the finger of the user under the outlet opening.

The shroud member tubular wall generally comprises a detent means disposed on the inner surface thereof for retaining the actuator within the tubular wall during upward movement of the actuator and the top wall of the actuator may contain a downwardly projecting arcuate portion formed on the outer edge and extending into the outer wall slotted opening the outer surface of the arcuate portion being of substantially equal diameter to the shroud outer wall, which is effective to inhibit rotation of the actuator in the shroud.

BRIEF DESCRIPTION OF THE DRAWING

Reference is made to the accompanying drawing in which there is shown an illustrative embodiment of the invention from which novel features and advantages will be apparent wherein.

DESCRIPTION OF THE PREFERRED EMBODIMENT

Figure 1:
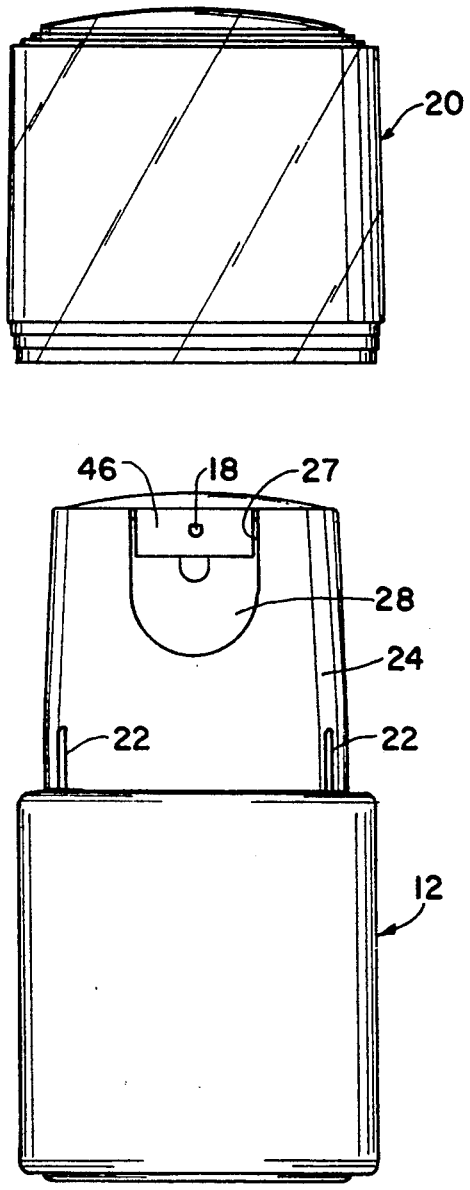
FIG. 1 is a front elevational view showing apparatus for dispensing a cosmetic or the like from a container, assembled to a container for which it is adapted and having the top removed to show details thereof.

Referring now to the drawing and in particular to FIGS. 1 through 7 there is shown dispensing apparatus 10 which has been mounted onto a container 12 having a cosmetic or the like contained therein. The dispensing apparatus 10 comprises a shroud 14 and an actuator 16 slidably engaged within the shroud for dispensing the material of the container 12 through an outlet opening 18 formed in the actuator.

The shroud 14 and actuator 16 are generally formed of a polypropylene or other substantially rigid plastic material and a cover member 20 is provided to fit over the dispensing apparatus 10 and completely cover the actuator 16 to prevent inadvertent dispensing of material from the container 12. The cover member 20 may be formed of a transparent plastic material and the inner diameter of the cover member is formed to fit snugly over three outwardly extending ribs 22, with the bottom surface of the cover member resting on the upper surface of the container 12.

Figure 2:
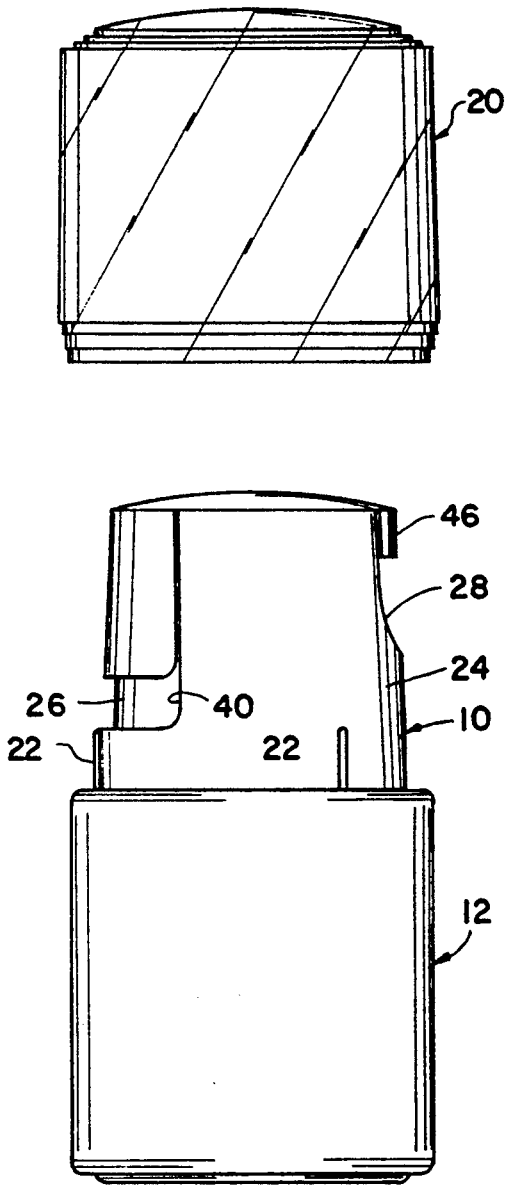
FIG. 2 is a right side elevational view showing the apparatus of FIG. 1, the left side view being a mirror image thereof.
Figure 4:
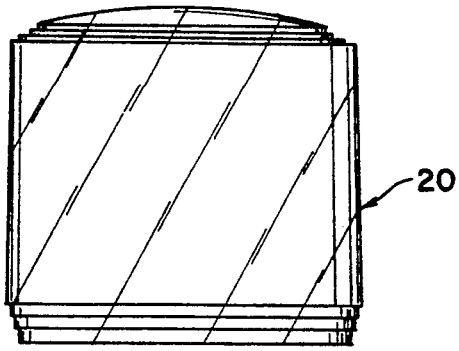
FIG. 4 is a bottom plan view showing details of the removable cover of FIGS. 1 through 3.
Figure 4:
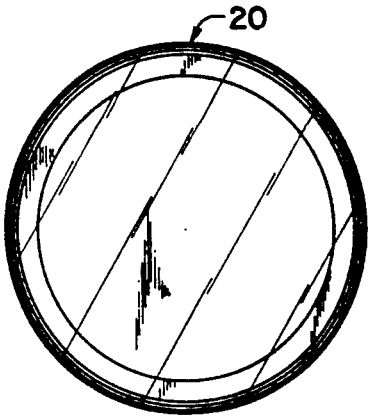

As best shown in FIGS. 1 and 2 the shroud 14 contains a tubular outer wall 24 the inner surface of which accommodates the outer surface 25 (shown in FIG. 9) of the actuator 16 for slidable movement therein, and a front slotted opening 27 in the wall 24 terminates in an inwardly extending recess 28 formed in the wall. The recess 28 is substantially concave in cross-section to provide for extending the finger of the user under the outlet opening 18.

Figure 3:
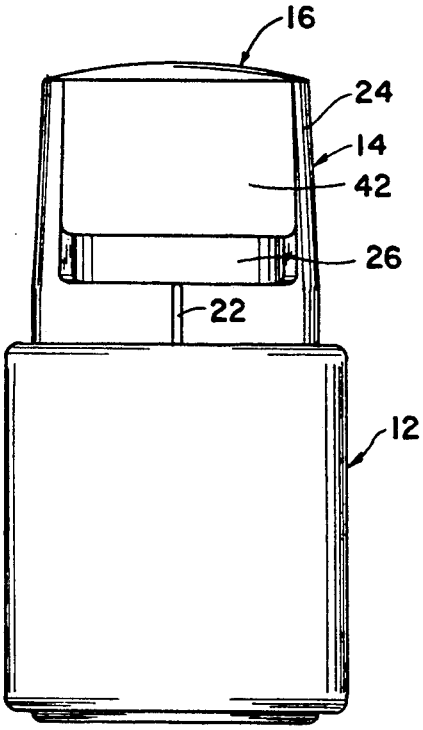
FIG. 3 is a rear elevational view showing the structure of FIGS. 1 and 2.
Figure 5:
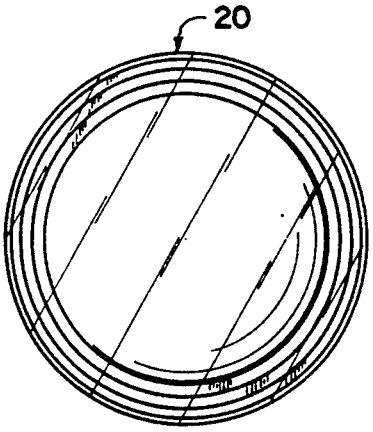
FIG. 5 is a top plan view showing further details of the removable cover of FIGS. 1 through 4.
Figure 6:
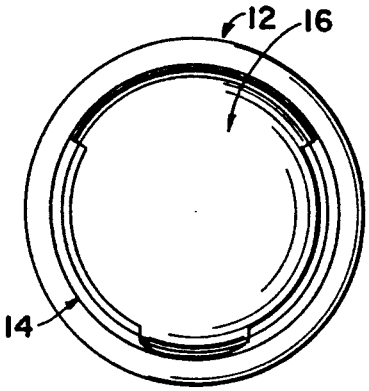
FIG. 6 is a top plan view showing the actuator and container of FIGS. 1 through 5 with the cover removed.
Figure 7:
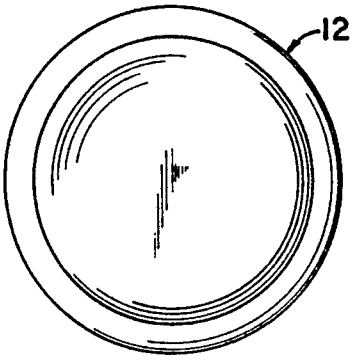
FIG. 7 is a bottom plan view showing the actuator and container of FIGS. 1 through 6, with the cover removed.
Figure 8:
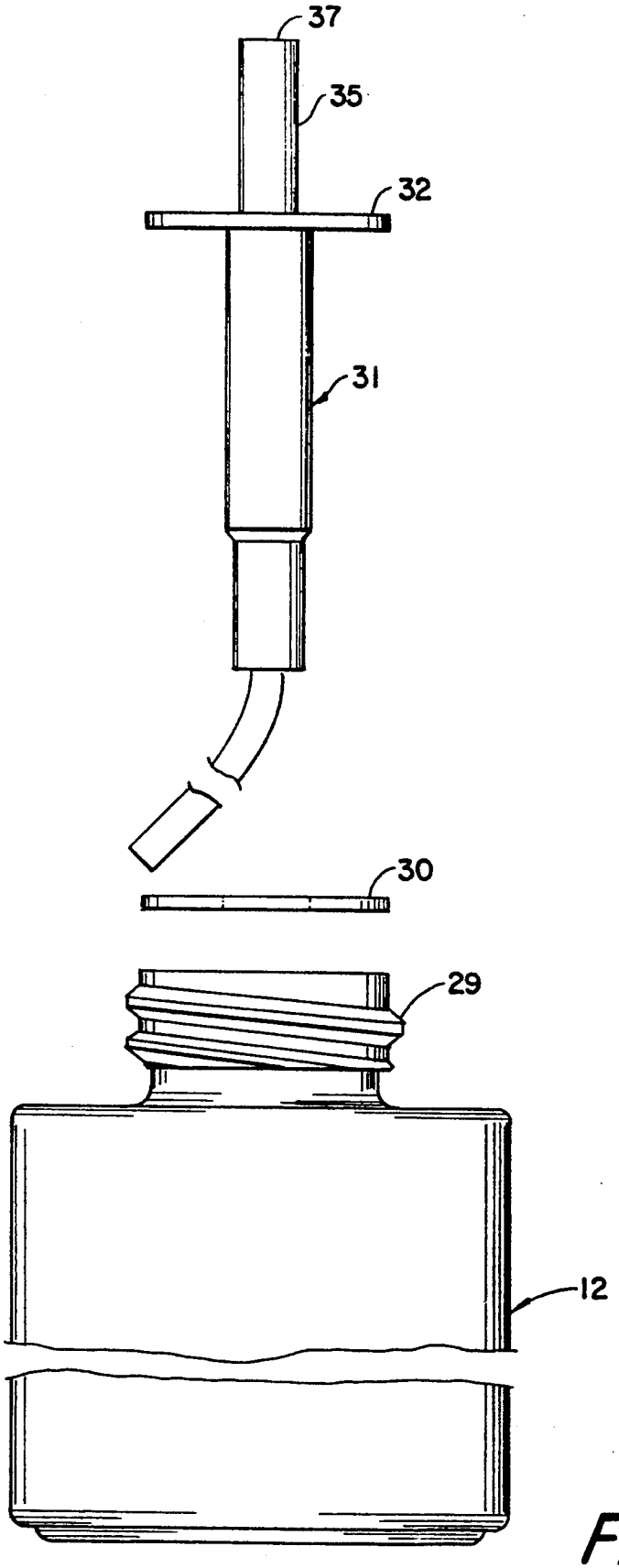
FIG. 8 is an exploded view showing details of the container and pump to which the dispensing apparatus of the present invention is assembled.

Referring now to FIGS. 8 through 11 taken together with the above-described FIGS. 1, 2 and 3, the container 12 may be of any desired volume and is of a construction similar to many cosmetic containers known in the art, having a threaded neck portion 29 over which a rubber washer 30 having a central opening is applied, a pump 31 having a flange 32 and a stem 35 being inserted through the central opening. A substantially standard-type bottle cap 34 having a central opening therein is applied over the flange 32 and washer 30 and screwed onto the threaded neck portion 29 to firmly affix the pump 31 onto the container 12. With the pump 31 in place, the pump stem 35 extends upwardly through the cap 34, the pump stem 35 being provided with a valve opening 37 on its top surface, through which pumped material is dispensed.

Details of the pump 31 will not be provided as pumps of the type wherein the stem is movable downward to draw material from a container and returned by spring action are well known in the art. The specific construction and detail of the elements contained in such a pump form no part of the present invention, it merely being necessary that the pump have a stem which is movable downwardly to pump material from the container through an opening in the stem for adaptation to the present invention.

Figure 9:
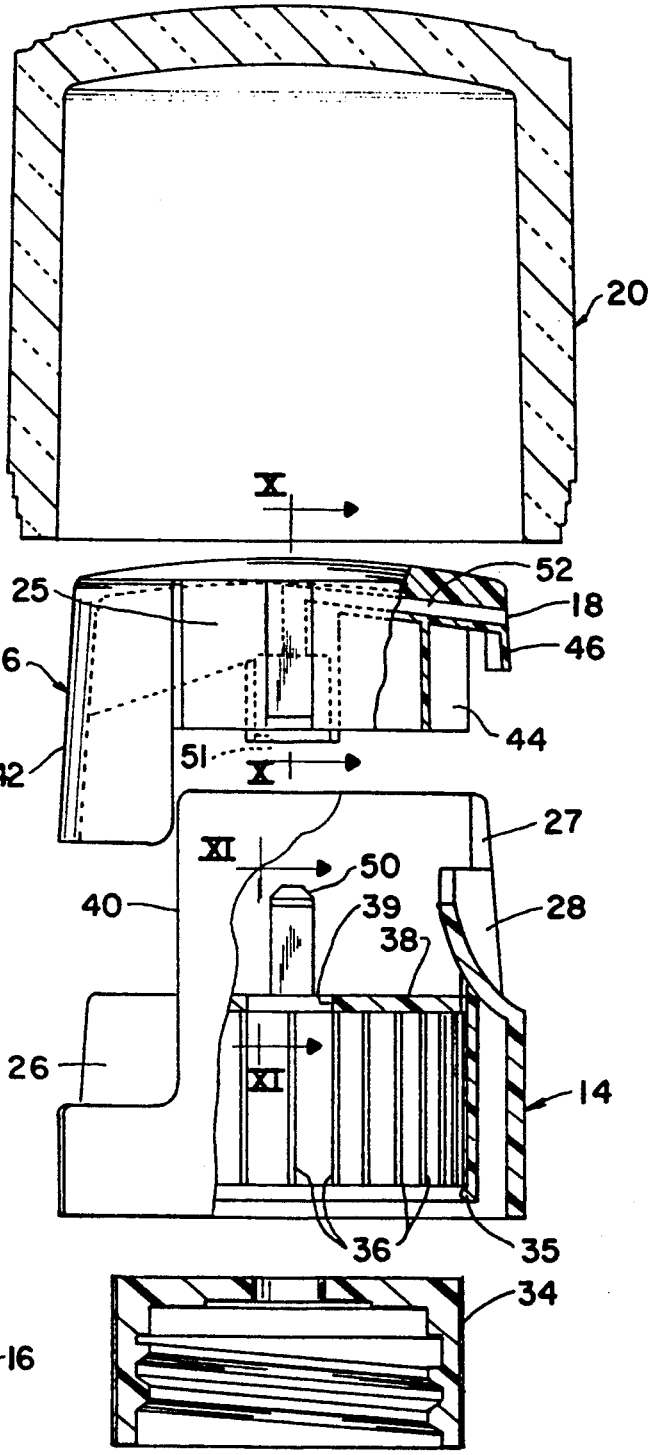
FIG. 9 is an exploded view, partially in section showing details of the dispensing apparatus of the present invention.
Figure 10:
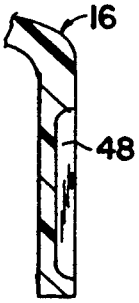
FIG. 10 is a sectional view taken along the lines X—X of FIG. 9 showing structural details of FIG. 9 on an enlarged scale for clarity.
Figure 11:
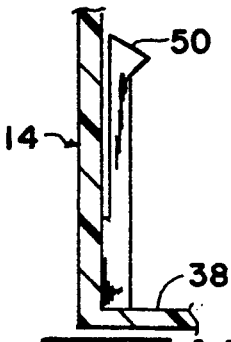
FIG. 11 is a sectional view taken along the lines XI—XI of FIG. 9 showing further structural details of FIG. 9 on an enlarged scale.

Referring now to FIGS. 9 through 11, the shroud 14 is shown to have an inner wall 35 having a plurality of axial splines 36 which are effective to grip the serrations on the outer surface of the bottle cap 34 and firmly affix the shroud to the container 12 thus preventing rotation of the dispensing apparatus 10 on the container 12. The shroud 14 has a radially extending platform 38 with a centrally disposed opening 39 through which the pump stem 35 extends when the shroud is placed on the container cap. In addition to the front slotted opening 27 the shroud 14 has a rear slotted opening 40 which contains the recessed outer diameter 26 of the shroud.

Turning now to the actuator 16, the actuator comprises a downwardly projecting arcuate portion 42 formed on the outer edge thereof extending into the outer wall slotted opening 40 and substantially of equal diameter as the shroud outer wall. At the opposite slotted opening 27 the actuator 16 comprises a concave surface 44 which is slidably received on the inner surface of the wall portion forming the concave recess 28 of the shroud 14. The arrangement of the outer surface 42 in the slotted opening 40 combined with a downwardly projecting arcuate portion 46 formed in the outer edge of the actuator, which is of substantially equal diameter to the shroud outer wall, inhibit rotation of the actuator in the shroud during slidable movement of the actuator within the shroud. Still referring to FIG. 9 taken in conjunction with FIGS. 10 and 11, the actuator 16 is provided with a pair of opposed recesses 48 on its outer surface, only one of which is shown in the drawing. The inner surface of the shroud 14 is provided with a pair of opposed detents 50 which are received in the recesses 48 and provide a stop means to ensure that the actuator 16 remains within the shroud 14 when moved in the upward direction due to spring action of the pump 31.

The actuator 16 is further provided with conduit 52 having an inlet 51 leading to the outlet 18 previously described. The inlet 51 is aligned with the central opening in the shroud 14 and therefore in alignment with the opening 37 in the pump stem 35 and is formed to receive the pump stem in interfitting engagement.

In operation, with the dispenser apparatus 10 assembled to the container 12 as shown in FIGS. 1, 2 and 3, and with the cover member 20 removed, the container 12 may be placed on a surface in the upright position in preparation for dispensing a material from the container 12. The user then places a finger in the recess 28 and by application of a slight pressure to the top surface of the actuator 16, the pump stem 35 will be forced downwardly and material pumped through the inlet 50 to the outlet 18 of the conduit 52 and onto the finger of the user. It will be noted that the container 12 need not be tipped in order to provide material from the container and therefore by maintaining the container in the upright position a maximum amount of material may be drawn from the container during usage. Thus a compact and simple actuator device is provided which is effective to withdraw a measured amount of material from a container as described.

While it is apparent that changes and modifications can be made within the spirit and scope of the present invention, it is our intention, however, only to be limited by the appended claims.

As our invention we claim:

1. Apparatus for dispensing material from a container having a pump including an operating stem extending from the container top and having a free end, said pump stem being movable downwardly to pump material from said container through an opening in said stem, said apparatus including a shroud member having a tubular outer wall open at the top and bottom and a radially extending platform having a centrally disposed opening formed therein located between said top and bottom opening, said shroud member being mounted on said container with said operating stem extending through said platform opening;

said outer wall having a front slotted opening formed therein extending from the top of said outer wall to a point above said platform and terminating at an inwardly extending recess formed in said outer wall;

an actuator having a cylindrical outer surface for slidable engagement with the inner surface of said shroud tubular wall and a top wall disposed in said shroud member;

said top wall of said actuator having a downwardly projecting arcuate portion formed on the outer edge thereof extending into said outer wall slotted opening and substantially of equal diameter as said shroud outer wall to inhibit rotation of said actuator in said shroud;

means disposed on the bottom surface of said top wall for contacting said stem and moving said stem downwardly to actuate the pump when said actuator is moved downwardly; and conduit means disposed in said actuator having an inlet communicating with said opening in said stem and an outlet disposed above said inwardly extending recess in said shroud member tubular outer wall.

2. Apparatus as set forth in claim 1 which further includes stop means for controlling downward movement of said actuator to limit the quantity of material dispensed by said apparatus.

3. Apparatus as set forth in claim 1 wherein said recess is substantially concave in cross-section to provide for extending the finger of the user under the outlet opening.

4. Apparatus as set forth in claim 1 wherein said shroud member tubular wall comprises detent means disposed on the inner surface thereof for retaining said actuator within said tubular wall during upward movement of said actuator.

5. Apparatus as set forth in claim 1 wherein said conduit means outlet is disposed in said actuator downwardly projecting arcuate portion.

6. Apparatus as set forth in claim 1 wherein said shroud member tubular wall is provided with a plurality of splines extending from said bottom open end upwardly and disposed on the wall inner surface for attachment of said shroud to said container.

7. Apparatus as set forth in claim 1 wherein said shroud member and said actuator are formed of a polypropylene material.

8. Apparatus as set forth in claim 1 wherein said shroud tubular outer wall has a second slotted opening formed at the rear thereof opposite said front slotted opening and said top wall of said actuator has a second downwardly projecting arcuate portion formed on the outer edge thereof extending into said second outer wall slotted opening and substantially of equal diameter as said shroud outer wall.

9. Apparatus as set forth in claim 2 wherein said recess is substantially concave in cross-section to provide for extending the finger of the user under the outlet opening.

10. Apparatus as set forth in claim 9 wherein said shroud member tubular wall comprises detent means disposed on the inner surface thereof for retaining said actuator within said tubular wall during upward movement of said actuator.

11. Apparatus as set forth in claim 10 wherein said conduit means outlet is disposed in said actuator downwardly projecting arcuate portion.

12. Apparatus as set forth in claim 11 wherein said shroud member tubular wall is provided with a plurality of splines extending from said bottom open end upwardly and disposed on the wall inner surface for attachment of said shroud to said container.

13. Apparatus as set forth in claim 12 wherein said shroud member and said actuator are formed of a polypropylene material.

* * * * *